US009203153B2

(12) United States Patent
Ogawa et al.

(10) Patent No.: US 9,203,153 B2
(45) Date of Patent: Dec. 1, 2015

(54) WIRELESS POWER TRANSMITTING DEVICE AND WIRELESS POWER RECEIVING DEVICE

(75) Inventors: Kenichirou Ogawa, Tokyo (JP); Noriaki Oodachi, Kawasaki (JP); Hiroki Kudo, Kawasaki (JP); Hiroki Shoki, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 797 days.

(21) Appl. No.: 13/235,739

(22) Filed: Sep. 19, 2011

(65) Prior Publication Data

US 2012/0161532 A1 Jun. 28, 2012

(30) Foreign Application Priority Data

Dec. 28, 2010 (JP) ..... 2010-294070

(51) Int. Cl.

| | |
|---|---|
| ***H01F 27/42*** | (2006.01) |
| ***H01F 37/00*** | (2006.01) |
| ***H01F 38/00*** | (2006.01) |
| ***H01Q 7/00*** | (2006.01) |

(52) U.S. Cl.

CPC ..... *H01Q 7/00* (2013.01)

(58) Field of Classification Search

USPC ..... 307/37, 104, 108, 109, 112, 113, 129

See application file for complete search history.

(56) References Cited

U.S. PATENT DOCUMENTS

| | | | | |
|---|---|---|---|---|
| 8,008,888 | B2 | 8/2011 | Oyobe et al. | |
| 8,378,522 | B2 | 2/2013 | Cook et al. | |
| 8,378,523 | B2 | 2/2013 | Cook et al. | |
| 8,482,157 | B2 | 7/2013 | Cook et al. | |
| 2008/0211320 | A1 | 9/2008 | Cook et al. | |
| 2011/0241440 | A1* | 10/2011 | Sakoda et al. | 307/104 |
| 2012/0080957 | A1* | 4/2012 | Cooper et al. | 307/104 |

FOREIGN PATENT DOCUMENTS

| | | | |
|---|---|---|---|
| JP | 2001-238372 | A * | 8/2001 |
| JP | 2001-320216 | A | 11/2001 |

(Continued)

OTHER PUBLICATIONS

Japanese Office Action (and English translation thereof) dated Mar. 31, 2015, issued in counterpart Japanese Application No. 2013-125995.

(Continued)

*Primary Examiner* — Rexford Barnie

*Assistant Examiner* — Xuan Ly

(74) *Attorney, Agent, or Firm* — Holtz, Holtz, Goodman & Chick PC

(57) ABSTRACT

A loop antenna includes: a pair of first linear elements, a feed point connected with each of the first linear elements, a first variable impedance element, one end of which is connected with one end of the first linear elements, a second variable impedance element, one end and the other end of which are electrically connected with the other end of the first variable impedance element and the other end of the first linear elements, and a second linear element, one end and the other end of which are electrically connected with the other end of the first variable impedance element and the other end of the first linear elements. A self-resonance coil receives power fed to the feed point of the loop antenna and transmits the received power to a receiving self-resonance coil.

6 Claims, 11 Drawing Sheets

(56) References Cited

FOREIGN PATENT DOCUMENTS

| | | | | |
|---|---|---|---|---|
| JP | 2002078247 | A | | 3/2002 |
| JP | 2006-287844 | A | * | 10/2006 |
| JP | 2009-106136 | A | | 5/2009 |
| JP | 2009-200748 | A | | 9/2009 |
| JP | 2009-543442 | A | | 12/2009 |
| JP | 2010-004257 | A | | 1/2010 |
| JP | 2010-4257 | A | * | 1/2010 |
| JP | 2010-28165 | A | * | 2/2010 |
| JP | 2010-028165 | A | | 2/2010 |
| JP | 2010028165 | A | * | 2/2010 |
| JP | 2010-141976 | A | | 6/2010 |
| JP | 2010-520716 | A | | 6/2010 |
| JP | 2011-155733 | A | | 8/2011 |
| WO | WO 2008/109489 | A2 | | 9/2008 |

OTHER PUBLICATIONS

Japanese Office Action dated Aug. 29, 2014, issued in counterpart Japanese Application No. 2013-125995.

Japanese Office Action dated Nov. 20, 2012 (and English translation thereof) in counterpart Japanese Application No. 2010-294070.

* cited by examiner

WIRELESS POWER TRANSMITTING DEVICE AND WIRELESS POWER RECEIVING DEVICE

CROSS REFERENCE TO RELATED APPLICATIONS

This application is based upon and claims the benefit of priority from the prior Japanese Patent Application No. 2010-294070, filed on Dec. 28, 2010, the entire contents of which are incorporated herein by reference.

FIELD

The embodiments of the present invention relate to a wireless power transmitting device and a wireless power receiving device and, more particularly, to adjusting resonance frequency of a coil.

BACKGROUND

When wireless power transmission is performed by using magnetic resonance, the resonance frequency of a coil may deviate from a designed value due to manufacturing unevenness or an external environment such as a near desk. As a result, the transmission efficiency deteriorates. In addition, if the frequency with which transmission is performed is changed, there is a need to vary the resonance frequency of a coil.

Conventionally, a method has been reported in which a capacitor is attached to a coil and a value of the capacitor is changed to vary the resonance frequency of a coil. However, this method poses a problem that parasitic resistance of a capacitor increases loss at the coil, leading to deteriorated transmission efficiency.

In addition, a method for inserting a capacitor in series with a loop coupled to a coil has been reported. However, this method poses a problem that an amount that can be adjusted is limited.

Furthermore, there are objects of improving a variable amount of resonance frequency and achieving the size reduction, the thickness reduction, the weight reduction, the lowered loss, the lowered cost, and the increased electric power of a coil.

DETAILED DESCRIPTION

There is provided a wireless power transmitting device including: a loop antenna and a self-resonance coil.

The wireless power transmitting device includes:

(A) a pair of first linear elements, (B) a feed point connected with each of the first linear elements, (C) a first variable impedance element, one end of which is connected with one end of the first linear elements, (D) a second variable impedance element, one end of which is electrically connected with the other end of the first variable impedance element and the other end of which is electrically connected with the other end of the first linear elements, and (E) a second linear element, one end of which is electrically connected with the other end of the first variable impedance element and the other end of which is electrically connected with the other end of the first linear elements.

The self-resonance coil receives, through electromagnetic coupling to the loop antenna, power fed to the feed point of the loop antenna and transmit the received power to a receiving self-resonance coil through magnetic resonance.

Embodiments will be described in detail below with reference to the drawings.

Figure 1:
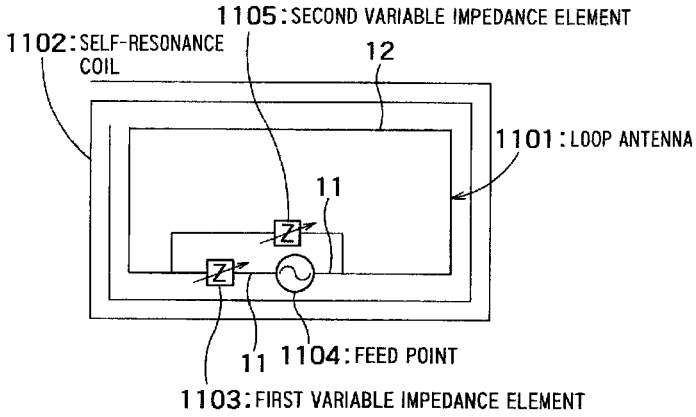
FIG. 1 illustrates a wireless power transmitting device according to an embodiment of the present invention.

FIG. 1 illustrates a configuration of a wireless power transmitting device (power-transmitting device) according to a first embodiment of the present invention.

Figure 2:
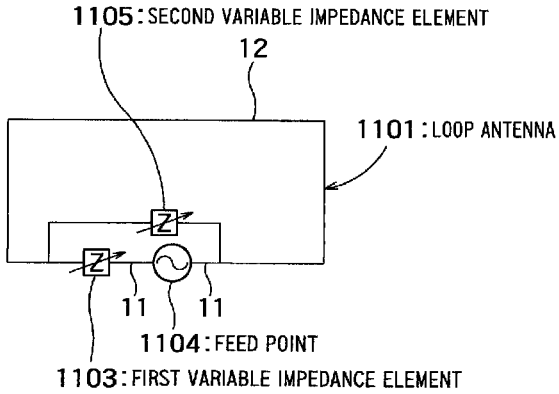
FIG. 2 illustrates a configuration example of a loop antenna.

The wireless power transmitting device in FIG. 1 includes a loop antenna 1101 and a self-resonance coil 1102. FIG. 2 illustrates the loop antenna 1101 of the wireless power transmitting device in FIG. 1.

The loop antenna 1101 includes (A) a pair of linear elements 11, (B) a feed point 1104 connected with each of the linear elements 11, (C) a first variable impedance element 1103, one end of which is connected with one end of the linear elements 11, (D) a second variable impedance element 1105, one end of which is electrically connected with the other end of the first variable impedance element 1103 and the other end of which is electrically connected with the other end of the linear elements 11, and (E) a linear element (line) 12, one end of which is electrically connected with the other end of the first variable impedance element 1103 and the other end of which is electrically connected with the other end of the linear elements 11. The linear elements 11 correspond to first linear elements and the linear element 12 corresponds to a second linear element.

The first variable impedance element 1103 is placed in series with the feed point 1104. The second variable impedance element 1105 is connected in parallel with the feed point 1104 and the first variable impedance element 1103. In the first variable impedance element 1103 and the second variable impedance element 1105, the impedance thereof can be each adjusted. The values of the first variable impedance element 1103 and the second variable impedance element 1105 are adjusted to make the resonance frequency of the self-resonance coil 1102 variable.

The linear elements 11 and 12 are, for example, wires (lines) made of metal such as copper. The linear elements 11 and 12 may be physically integrally formed by folding one wire or may be made by connecting separate wires with each other through soldering or the like.

Each of one end and the other end of the second variable impedance element 1105 may be electrically connected with the other end of the first variable impedance element 1103 and the other end of the linear elements 11 via a linear element (line). Also, it is essential only that the second variable impedance element 1105 be electrically connected; as a physical connection configuration, one end of the second variable impedance element 1105 may be connected with the linear element 12 instead of being connected with the other end of the first variable impedance element 1103. Furthermore, the other end of the second variable impedance element 1105 may be connected with the linear element 12 instead of being connected with the other end of the linear elements 11.

The self-resonance coil 1102 is a coil that resonates with a predetermined frequency in accordance with self-inductance and self-capacitance. For example, the self-resonance coil 1102 is a coil in which the number of turns is n (n is an integer greater than or equal to 1). It should be noted that a form of the self-resonance coil 1102 may be arbitrary. For example, a cylinder, a quadrangular prism, and a planar spiral form may be adopted. The illustrated self-resonance coil 1102 has a planar spiral form.

The self-resonance coil 1102 and the loop antenna 1101 are placed at the same height (on the same plane), so that the present wireless power transmitting device has a planar structure (see FIG. 15 described later).

The self-resonance coil 1102 receives, through electromagnetic coupling to the loop antenna 1101, power fed to the feed point 1104 of the loop antenna 1101 and transmits the received power to a receiving self-resonance coil through magnetic resonance. It should be noted that the power that is fed to the feed point 1104 is generated by a high frequency energy generating circuit (not shown) connected to the loop antenna 1101. The generated power is fed to the feed point 1104 via a feeding line such as a coaxial cable and a microstrip line.

Figure 3:
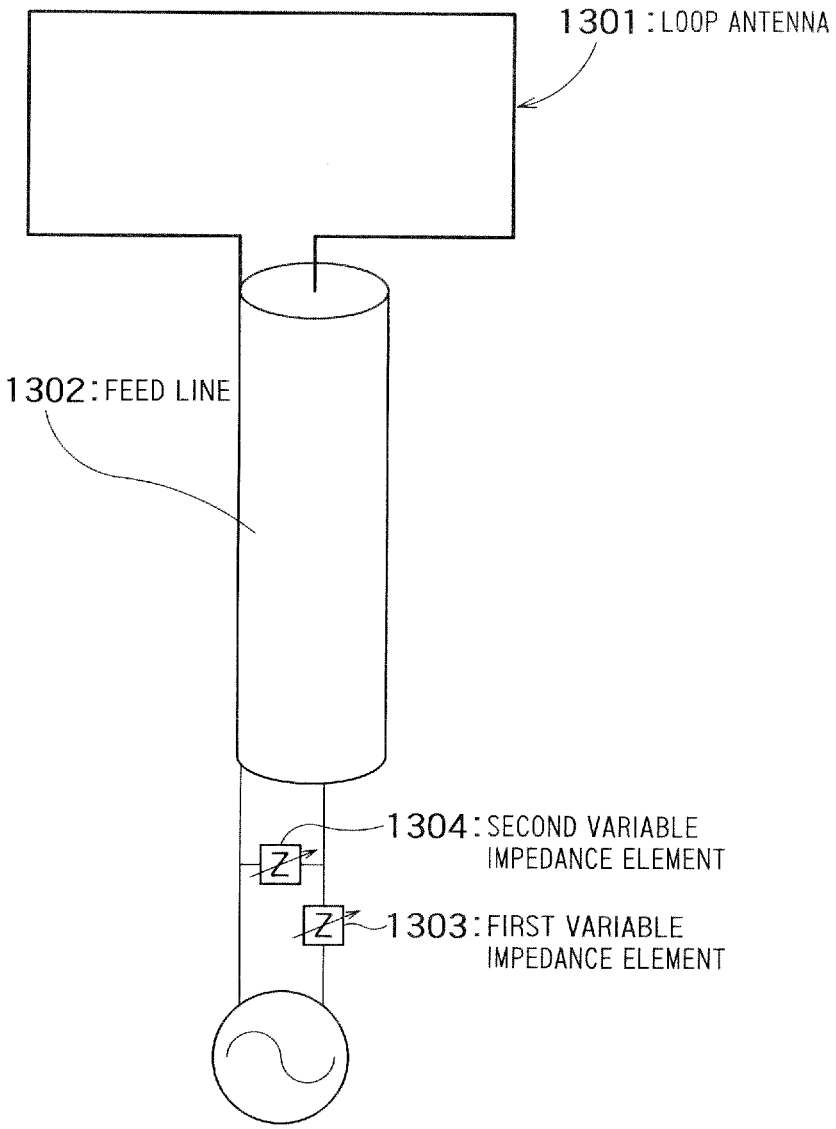
FIG. 3 illustrates another configuration example of a loop antenna.

FIG. 3 illustrates a modified example of the placement of the first and the second variable impedance elements.

As illustrated in FIG. 3, if an installation space for a loop antenna 1301 is limited because of a longer feeding line 1302 to the loop antenna 1301, a first variable impedance element 1303 and a second variable impedance element 1304 may be placed in another site (over the feeding line).

However, because the impedance of the loop antenna 1301 varies depending on the length of the feeding line 1302, values of the first variable impedance element 1303 and the second variable impedance element 1304 need to be determined depending on the length of the feeding line 1302.

Figure 4:
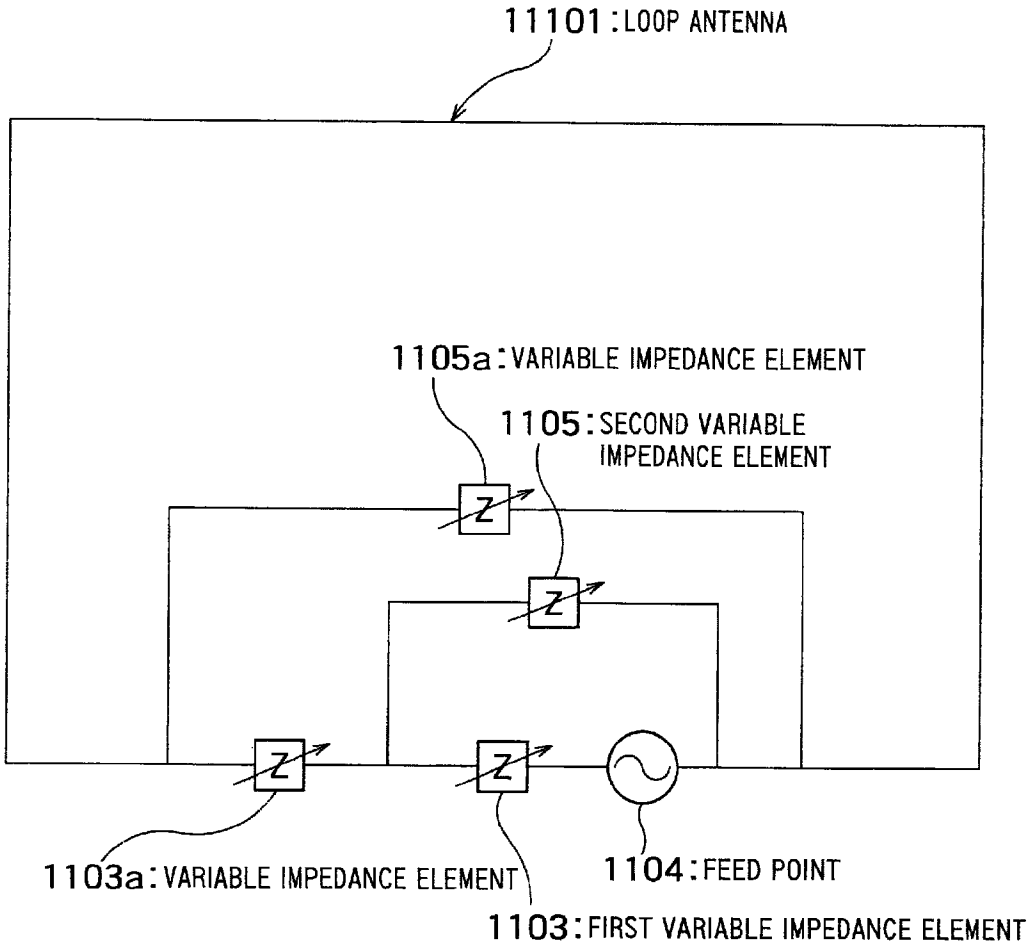
FIG. 4 illustrates a modified example of a loop antenna.

FIG. 4 illustrates a loop antenna 11101 having a double configuration of the placements of the variable impedance elements illustrated in FIG. 1 and FIG. 2 (variable impedance elements are connected in series and in parallel with a feed point).

A variable impedance element 1103*a* is additionally placed in series with the feed point 1104 and a variable impedance element 1105*a* is additionally placed in parallel with the feed point 1104. This arrangement enables a resonance frequency to be adjusted more finely.

This example illustrates the double configuration, but a triple or greater configuration can also be achieved in the same manner.

FIGS. 5, 6, 7, and 8 illustrate specific examples of the first and the second variable impedance elements.

Figure 5:
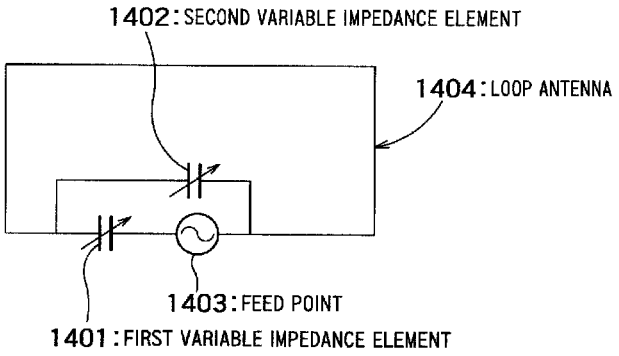
FIG. 5 illustrates a specific example of a variable impedance element.

In the example shown in FIG. 5, a first variable impedance element 1401 is a capacitance value variable capacitor, and a second variable impedance element 1402 is also a capacitance value variable capacitor. Reference numeral 1404 denotes a loop antenna and reference numeral 1403 denotes a feed point.

Figure 6:
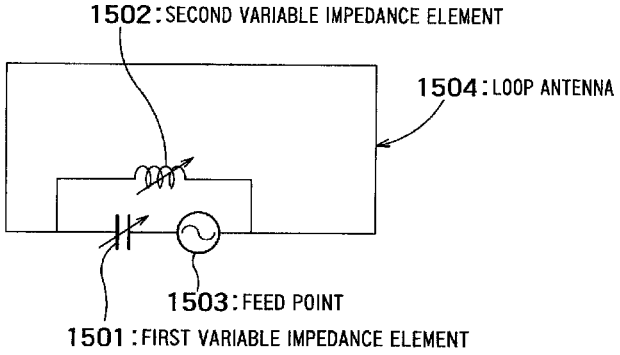
FIG. 6 illustrates a specific example of a variable impedance element.

In the example shown in FIG. 6, a first variable impedance element 1501 is a capacitance value variable capacitor, and a second variable impedance element 1502 is a capacitance value variable inductor. Reference numeral 1504 denotes a loop antenna and reference numeral 1503 denotes a feed point.

Figure 7:
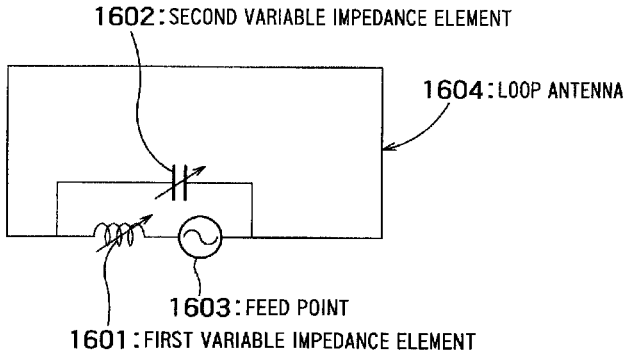
FIG. 7 illustrates a specific example of a variable impedance element.

In the example shown in FIG. 7, a first variable impedance element 1601 is a capacitance value variable inductor, and a second variable impedance element 1602 is a capacitance value variable capacitor. Reference numeral 1604 denotes a loop antenna and reference numeral 1603 denotes a feed point.

Figure 8:
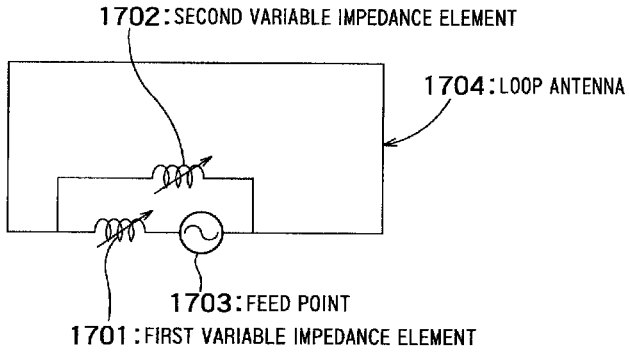
FIG. 8 illustrates a specific example of a variable impedance element.

In the example shown in FIG. 8, a first variable impedance element 1701 is a capacitance value variable inductor, and a second variable impedance element 1702 is also a capacitance value variable inductor. Reference numeral 1704 denotes a loop antenna and reference numeral 1703 denotes a feed point.

In FIG. 5 to FIG. 8, each of the first and the second variable impedance elements is composed of a single element, but each of them may also be composed of a plurality of elements.

Figure 9:
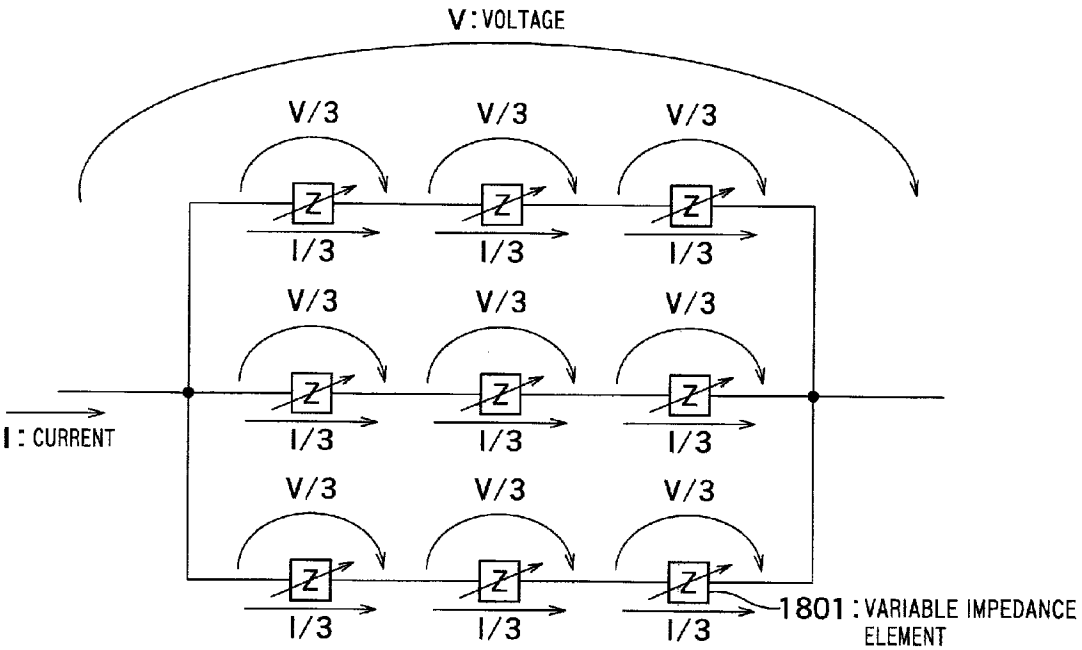
FIG. 9 illustrates a specific example of a variable impedance element.

FIG. 9 illustrates an example in which a plurality of elements compose a first variable impedance element.

In FIG. 9, the first variable impedance element is provided by parallel connecting element rows in each of which a plurality of elements (variable impedance elements) 1801 are connected in series. A second variable impedance element may also be composed in the same manner. This can increase a withstand voltage and a withstand current.

That is, the elements 1801 are connected in series, and thereby a voltage applied to one element can be reduced. In addition, a plurality of portions each of which has the elements 1801 connected in series are connected in parallel, and thereby a current flowing in one element can be reduced. This allows the use of the voltage and current greater than withstand voltage and withstand current values for one element.

The following describes that the values of the first and the second variable impedance elements are adjusted to allow resonance frequency to be finely set.

For example, if the frequencies of the self-resonance coil 1102 have no deviation and are in a matched state, assume that impedance at resonance frequency $f_a$ is 2+0j. Also, if the resonance frequency of the self-resonance coil 1102 deviates due to an external factor or the like, assume that impedance at the original resonance frequency $f_a$ becomes 1-0.5j. At this time, since the impedance at the frequency $f_a$ deviates from 2+0j, the impedance is unmatched and power transmission efficiency is reduced.

As an adjusting procedure, for example, a value of the first variable impedance element 1103 connected in series is adjusted, and thereby the impedance is adjusted from 1-0.5j to 1-j. If the admittance at this time is calculated using 1/(1-j), then 0.5+0.5j is obtained. Then, a value of the parallel connected second variable impedance element 1105 is adjusted, and thereby the admittance is adjusted from 0.5+0.5j to 0.5+0j. If the impedance at this time is calculated using 1/(0.5+0j), then 2+0j is obtained. In accordance with the procedure, the values of the first variable impedance element 1103 and the second variable impedance element 1105 can be adjusted to provide matching at the resonance frequency $f_a$, and thereby the transmission efficiency is improved. Regarding an adjusting procedure, the value of the second variable impedance element 1105 is adjusted, and thereafter the value of the first variable impedance element 1103 may be adjusted.

Furthermore, assuming that the minimum value is $Z_{MIN}$ and the maximum value is $Z_{MAX}$ within a variable range of a variable impedance element, an initial value of the values of the variable impedance element is set to a midpoint of the variable range, i.e., $(Z_{MIN}+Z_{MAX})/2$. Accordingly, the value of the variable impedance element can be increased as well as decreased by an adjustment, so that the range of adjustment can be extended.

Figure 10:
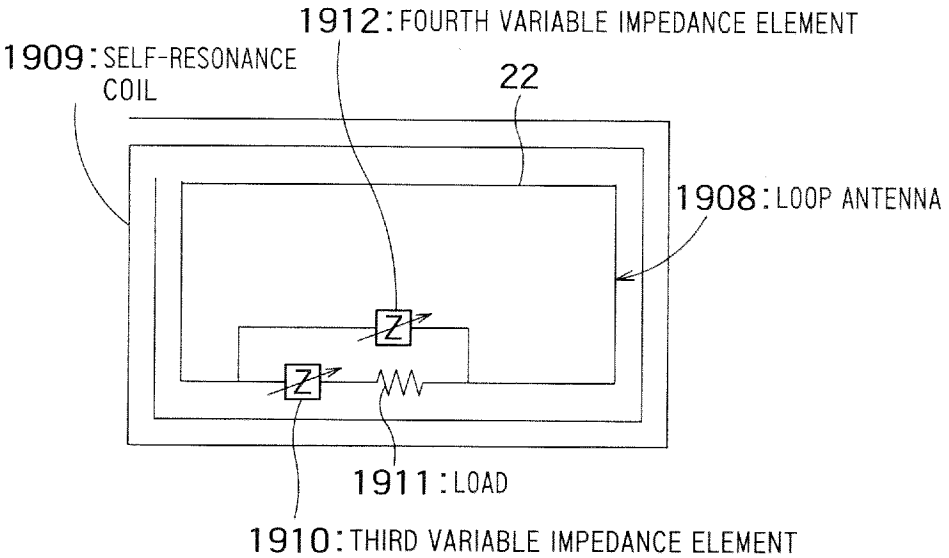
FIG. 10 illustrates a wireless power receiving device according to an embodiment of the present invention.

FIG. 10 illustrates a configuration of a wireless power receiving device (power-receiving device) according to the first embodiment of the present invention. It is basically the same configuration as that of the transmitting device in FIG. 1, but in the wireless power receiving device, a feed point is replaced by a load. Note that the different names of the feed point and the load are seen, but the same configuration may also be adopted in an implementation.

The wireless power receiving device in FIG. 10 includes a self-resonance coil 1909 and a loop antenna 1908.

The self-resonance coil 1909 receives power from a transmitting self-resonance coil through magnetic resonance.

The loop antenna 1908 includes (A) a load 1911, (B) a third variable impedance element 1910, one end of which is connected with one end of the load 1911, (C) a fourth variable impedance element 1912, one end of which is electrically connected with the other end of the third variable impedance element 1910 and the other end of which is electrically connected with the other end of the load 1911, and (D) a linear element 22, one end of which is electrically connected with the other end of the third variable impedance element 1910 and the other end of which is electrically connected with the other end of the load 1911.

The loop antenna 1908 is electromagnetically coupled to the self-resonance coil 1909 to receive the power (high frequency energy) and outputs the received power to the following stage through the load 1911. The following stage may include, for example, a rectifier circuit that is connected with the loop antenna 1908 and converts high frequency energy into a direct current, an electronic circuit that operates by using the output current from the rectifier circuit, or a secondary battery charged using the output current from the rectifier circuit.

Regarding a specific implementation of a variable impedance element and resonance frequency adjustment, those of the wireless power transmitting device can be applied in the same manner, so that detailed description thereof is omitted.

Figure 11:
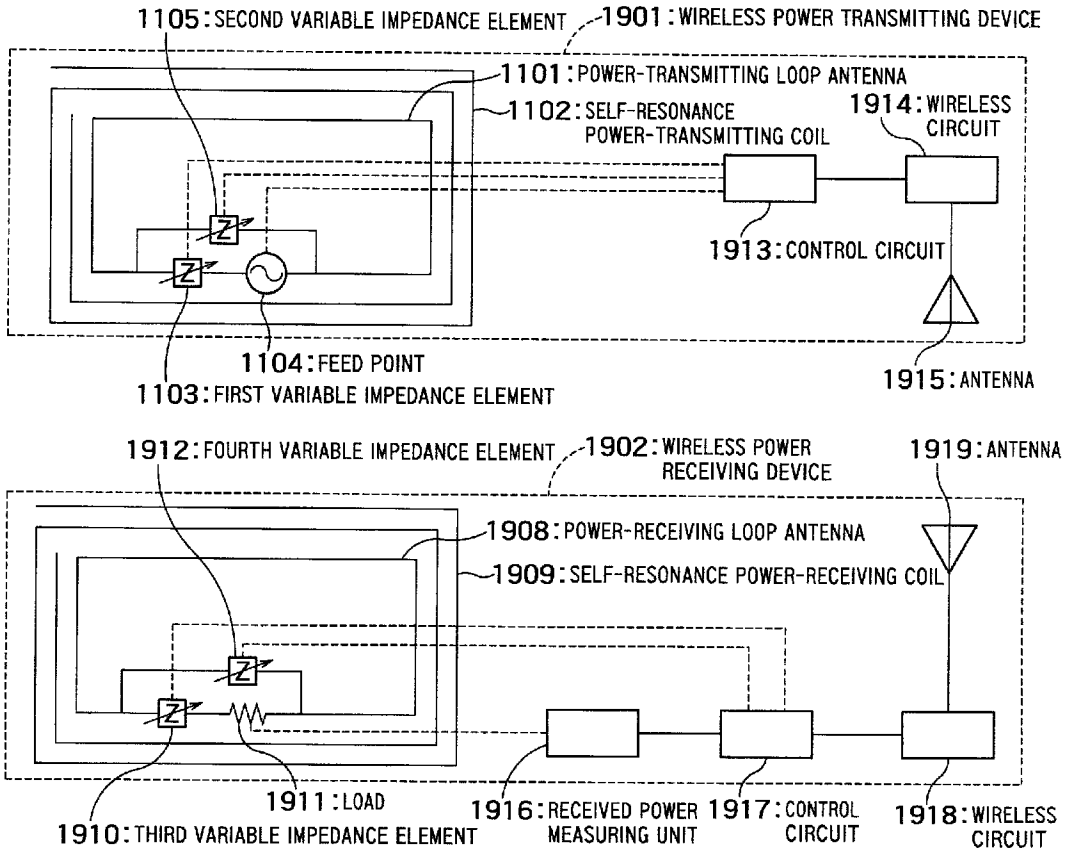
FIG. 11 illustrates an example of a system configuration including a wireless power transmitting device and a wireless power receiving device.

FIG. 11 illustrates a wireless power transmitting device 1901 having the configuration in FIG. 1 and a wireless power receiving device 1902 having the configuration in FIG. 10. For simplicity, a loop antenna and a self-resonance coil at a transmitting side are referred to as the power-transmitting loop antenna and the self-resonance power-transmitting coil, respectively, and a loop antenna and a self-resonance coil at a receiving side are referred to as the power-receiving loop antenna and the self-resonance power-receiving coil, respectively. The same reference numerals are used for denoting the same components in FIG. 1 and FIG. 10, and a redundant description thereof is omitted.

The wireless power transmitting device 1901 includes a power-transmitting loop antenna 1101, a self-resonance power-transmitting coil 1102, a control circuit 1913, a wireless circuit 1914, and an antenna 1915.

The wireless power receiving device 1902 includes a power-receiving loop antenna 1908, a self-resonance power-receiving coil 1909, an antenna 1919, a wireless circuit 1918, a control circuit 1917, and a received power measuring unit 1916.

Now, an operation example of power transmission between both the devices and an example of a procedure to adjust resonance frequency will be described.

The power-transmitting loop antenna 1101 and the self-resonance power-transmitting coil 1102 (resonator) are electromagnetically coupled to each other, and high frequency energy is supplied to the power-transmitting loop antenna 1101 through the feed point 1104. A portion of the high frequency energy supplied to the power-transmitting loop antenna 1101 is transmitted to the self-resonance power-transmitting coil 1102 (resonator) through electromagnetic induction.

The self-resonance power-transmitting coil 1102 (resonator) and the self-resonance power-receiving coil 1909 (resonator) are magnetically coupled to each other, and a portion of the high frequency energy of the self-resonance power-transmitting coil 1102 (resonator) is transmitted to the self-resonance power-receiving coil 1909 (resonator) through magnetic resonance.

The power-receiving loop antenna 1908 and the self-resonance power-receiving coil 1909 (resonator) are electromagnetically coupled to each other, a portion of the high frequency energy of the self-resonance power-receiving coil 1909 (resonator) is transmitted to the power-receiving loop antenna 1908 through electromagnetic induction, and the high frequency energy can be extracted from the load 1911 of the power-receiving loop antenna 1908.

A resonance frequency f of the self-resonance power-transmitting coil and the self-resonance power-receiving coil is dependent mainly upon their own inductance L and capacitance C of a line therebetween, and may be expressed in the following formula.

$$f = \frac{1}{2\pi\sqrt{LC}}$$

In addition, when the self-resonance power-transmitting coil and the self-resonance power-receiving coil operate with the same frequency, the power transmission efficiency between the power-transmitting and power-receiving devices becomes maximum.

Assuming that inductance of the loop antenna is La and inductance of the self-resonance coil is Lc, the relationship between mutual inductance M and a coupling coefficient k of the loop antenna and the self-resonance coil may be expressed in the following formula.

$$M=k\sqrt{La\times Lc}$$

The mutual inductance M can be adjusted by changing the distance between the loop antenna and the self-resonance coil, and impedance matching provided by adjusting the mutual inductance M between the wireless power transmitting device and the wireless power receiving device can maintain the high transmission efficiency. That is, impedance conversion is performed by using the loop antenna.

It should be noted that in FIG. 11, a high frequency energy supplying circuit that is connected with the feed point 1104 of the power-transmitting loop antenna 1102 is omitted. Moreover, a rectifier circuit that converts high frequency energy extracted from the power-receiving loop antenna 1908 into a direct current, an electronic circuit that operates by using the output current from the rectifier circuit, and a secondary battery charged using the output current from the rectifier circuit are omitted.

Figure 12:
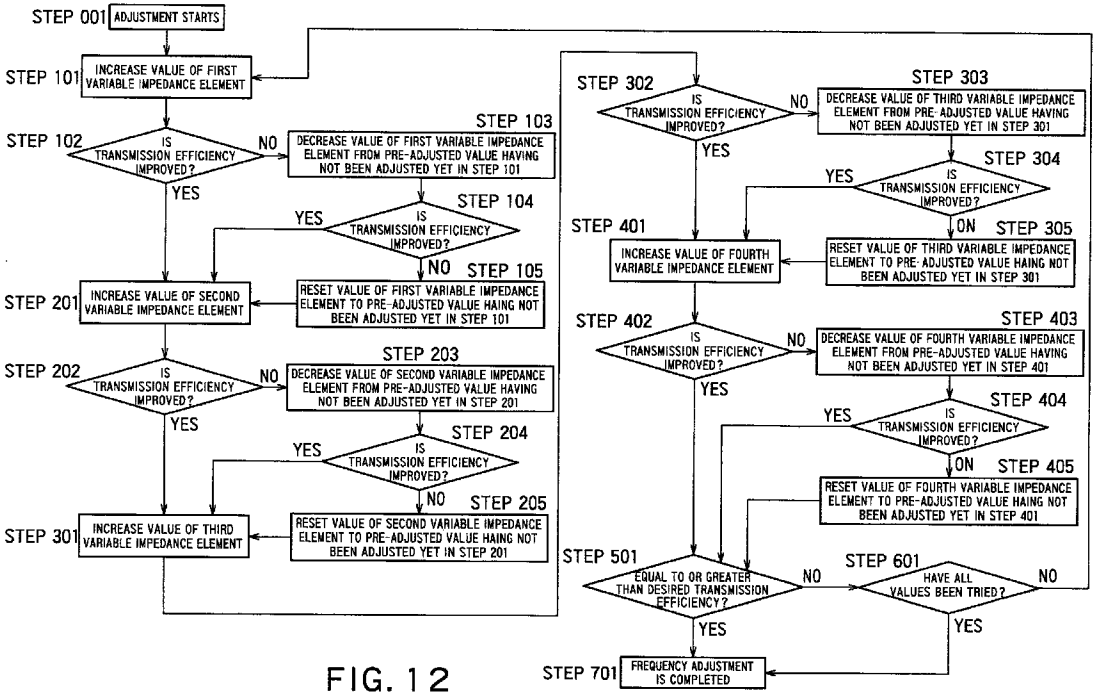
FIG. 12 illustrates a flow chart for explaining a frequency adjusting procedure.

FIG. 12 illustrates a procedure of the resonance frequency adjustment carried out between the wireless power transmitting device and the wireless power receiving device.

In step 001, frequency adjustment starts. That is, through the information exchange between the control circuit 1913 of the wireless power transmitting device 1901 and the control circuit 1917 of the wireless power receiving device 1902, the devices enter a frequency adjusting mode. An initial value of each of the first to the fourth variable impedance elements is set to an intermediate value between a maximum value and a minimum value within an adjustable range of each variable impedance element.

In step 101, the control circuit 1913 increases a value of the first variable impedance element by 5% of the adjustable range. The high frequency energy generating circuit supplies the high frequency energy of the increased value to the power-transmitting loop antenna 1101 in accordance with an instruction from the control circuit 1913. The supplied high frequency energy is extracted through the self-resonance power-transmitting coil 1102, the self-resonance power-receiving coil 1909, and the power-receiving loop antenna 1908, and determined by the received power measuring unit 1916. The control circuit 1917 of the wireless power receiving device 1902 transmits the measured received power value to the wireless power transmitting device 1901 via the wireless circuit 1918 and the antenna 1919. In the wireless power transmitting device 1901, the measured received power value is received by the control circuit 1913 via the antenna 1915 and the wireless circuit 1914.

In step 102, the control circuit 1913 carries out a test to determine whether the transmission efficiency is improved. The transmission efficiency may be calculated using a received power value/transmitted power value and if the transmitted power value is constant, the received power value itself may be used as the transmission efficiency. If the transmission efficiency is improved, the processing proceeds to step 201. If the transmission efficiency is not improved, in step 103, the control circuit 1913 decreases the value of the first variable impedance element by 5% of the adjustable range from the pre-adjusted value having not been adjusted yet in step 101. As a result, if the transmission efficiency is improved, the processing proceeds to step 201. If the transmission efficiency is not improved, in step 105, the control circuit 1913 resets the value of the first variable impedance element to the pre-adjusted value having not been adjusted yet in step 101, and then the processing proceeds to step 201.

Next, in step 201, the control circuit 1913 increases the value of the second variable impedance element by 5% of the adjustable range. As a result, if the transmission efficiency is improved, the processing proceeds to step 301. If the transmission efficiency is not improved, in step 203, the control circuit 1913 decreases the value of the second variable impedance element by 5% of the adjustable range from the pre-adjusted value having not been adjusted yet in step 201. As a result, if the transmission efficiency is improved, the processing proceeds to step 301. If the transmission efficiency is not improved, in step 205, the control circuit 1913 resets the value of the second variable impedance element to the pre-adjusted value having not been adjusted yet in step 201, and then the processing proceeds to step 301. At this time, the control circuit 1913 transmits an instruction to adjust the values of the third and the fourth variable impedance elements to the control circuit 1917 of the wireless power receiving device 1902 via the antenna 1915.

Next, in step 301, the control circuit 1917 increases the value of the third variable impedance element by 5% of the adjustable range. The control circuit 1917 notifies the control circuit 1913 of the wireless power transmitting device 1901 that the value is increased and carries out power transmission in the same manner as described above. As a result, if the transmission efficiency is improved, the processing proceeds to step 401. If the transmission efficiency is not improved, in, the control circuit 1917 decreases the value of the third variable impedance element by 5% of the adjustable range from the pre-adjusted value having not been adjusted yet in step 301. As a result, if the transmission efficiency is improved, the processing proceeds to step 401. If the transmission efficiency is not improved, in step 305, the control circuit 1917 resets the value of the third variable impedance element to the pre-adjusted value having not been adjusted yet in step 301, and then the processing proceeds to step 401.

Next, in step 401, the control circuit 1917 increases the value of the fourth variable impedance element by 5% of the adjustable range. As a result, if the transmission efficiency is improved, the processing proceeds to step 501. If the transmission efficiency is not improved, in step 403, the control circuit 1917 decreases the value of the fourth variable impedance element by 5% of the adjustable range from the pre-adjusted value having not been adjusted yet in step 401. As a result, if the transmission efficiency is improved, the processing proceeds to step 501. If the transmission efficiency is not improved, in step 405, the control circuit 1917 resets the value of the fourth variable impedance element to the pre-adjusted value having not been adjusted yet in step 401, and then the processing proceeds to step 501.

In step 501, the values of the first to the fourth variable impedance elements are set to the values determined in the foregoing steps and the power transmission is carried out. Then, the control circuit 1913 determines whether the power transmission efficiency is equal to or greater than a desired value. If the power transmission efficiency is equal to or greater than the desired value, the processing proceeds to step 701 where the frequency adjustment ends. If the power transmission efficiency is lower than the desired value, the processing proceeds to step 601.

In step 601, the control circuit 1913 carries out a test to determine whether all the values of the first to the fourth variable impedance elements have been tried. If all the values have been tried, the processing proceeds to step 701 where the frequency adjustment ends, and a combination of the tried values that produces the highest transmission efficiency is applied to the first to the fourth variable impedance elements. If all the values have not been tried, the processing returns to step 101.

The resonance frequency adjustment is carried out with the foregoing procedure, and then the power transmission is carried out. As a result, high received power is obtained. In other words, power transmission can be carried out with the resonance frequency of the wireless power transmitting device and the wireless power receiving device optimized.

Figure 13:
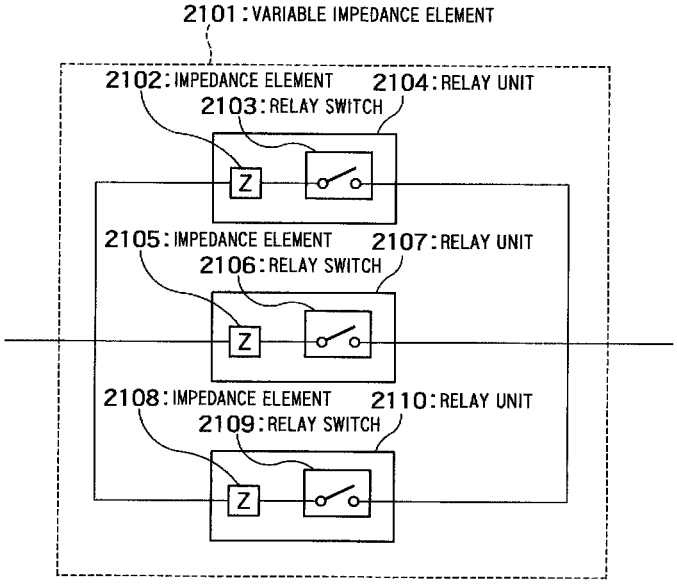
FIG. 13 illustrates a configuration example of a variable impedance element that uses relay switches.

FIG. 13 illustrates a configuration example of a variable impedance element that uses relay switches. This configuration may be applied to each configuration of the first to the fourth variable impedance elements.

A variable impedance element 2101 is configured by parallel connecting a relay unit 2104 in which an impedance element 2102 and a relay switch 2103 are serially connected, a relay unit 2107 in which an impedance element 2105 and a relay switch 2106 are serially connected, and a relay unit 2110 in which an impedance element 2108 and a relay switch 2109 are serially connected.

A value of the variable impedance element 2101 can vary by switching between the relay switch 2103 and the relay switch 2106 and the relay switch 2109. One relay switch may be turned on and two or three relay switches may also be turned on at the same time. The impedance element 2102, the impedance element 2105, and the impedance element 2108 may be configured by impedance elements each having a different value.

The impedance element 2102, the impedance element 2105, and the impedance element 2108 each may be a capacitor or an inductor.

In addition, the relay unit 2104, the relay unit 2107, and the relay unit 2110 may be connected in series.

Figure 14:
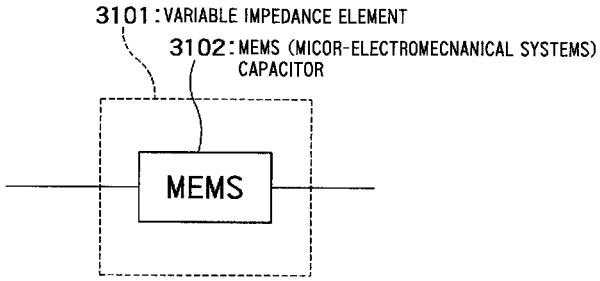
FIG. 14 illustrates a configuration example of a variable impedance element that uses MEMS.

FIG. 14 illustrates a configuration example of a variable impedance element that uses MEMS (micro-electromechanical systems). This configuration may be applied to each configuration of the first to the fourth variable impedance elements.

A variable impedance element 3101 is a MEMS (micro-electromechanical systems) capacitor 3102. Because the MEMS capacitor 3102 does not need a relay switch or the like and has small parasitic resistance, increased transmission efficiency can be provided.

Figure 15:
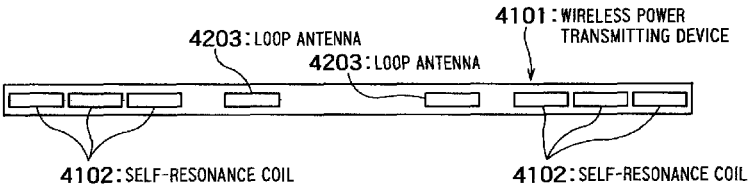
FIG. 15 illustrates an example of a wireless power transmitting device having a planar structure.

FIG. 15 is a longitudinal cross section view of a wireless power transmitting device 4101 according to a second embodiment of the present invention.

Self-resonance coils 4102 are wound into a planar form, and the self-resonance coils 4102 and loop antennas 4103 are placed at the same height (on the same plane). In FIG. 15, the self-resonance coils 4102 and the loop antennas 4103 are embedded in a thin dielectric. The self-resonance coils 4102 and the loop antennas 4103 are placed on the same plane, and thereby the increase in the thickness of the wireless power transmitting device 4101 can be minimized. As a result, they are enabled to be embedded into a slim device.

It should be noted that as described above, as with FIG. 15, also in the wireless power transmitting device that is illustrated in the first embodiment and FIG. 1, the self-resonance coil and the loop antenna are placed at the same height and the self-resonance coil is wound into a planar form.

Figure 16:
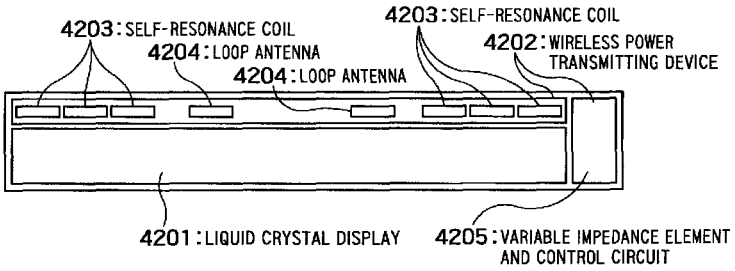
FIG. 16 illustrates an installation example of a wireless power transmitting device in equipment.

FIG. 16 illustrates an installation example in which the wireless power transmitting device 4202 is embedded in the back of a liquid crystal display 4201 such as a notebook PC (personal computer).

If an installation site for the wireless power transmitting device 4202 is limited, only self-resonance coils 4203 and loop antennas 4204 are installed in the back of the liquid crystal display 4201 and a variable impedance element and control circuit 4205 is installed in an edge, which does not include the liquid crystal display, and thereby the thickness reduction is achieved.

Figure 17:
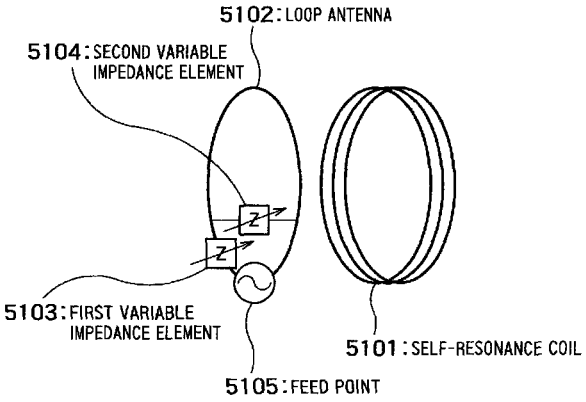
FIG. 17 illustrates an example of a wireless power transmitting device having a cubic structure.

FIG. 17 illustrates a wireless power transmitting device according to a third embodiment of the present invention.

A self-resonance coil 5101 has a cubic helical structure. The cubic helical structure can provide larger self-inductance L and higher transmission efficiency than those of the coil of the planar structure (see FIG. 15). The self-resonance coil 5101 and a loop antenna 5102 may not be on the same plane.

Reference numeral 5103 denotes a first variable impedance element, reference numeral 5104 denotes a second variable impedance element, and reference numeral 5105 denotes a feed point.

In this example, the loop antenna 5102 and the self-resonance coil 5101 have a circular planar form (In FIG. 1, planar forms of the loop antenna and the self-resonance coil are rectangular).

As described above, according to the embodiments of the present invention, since the first and the second variable impedance elements are placed at the loop antenna, the resonance frequency of a self-resonance coil can be adjusted finely (with extreme minuteness). At this time, because a capacitor is not attached to the self-resonance coil as in a conventional manner, the deterioration of the transmission efficiency does not occur. Thus, while the transmission deterioration is controlled, the resonance frequency of the self-resonance coil can be adjusted finely (with extreme minuteness).

It should be noted that the invention may be used for applications other than wireless power transmission. For example, wireless communications can be carried out by modulating high frequency of transmission. In this case, transmitting and receiving hardware for wireless communications may be used.

The present invention is not limited to the exact embodiments described above and can be embodied with its components modified in an implementation phase without departing from the scope of the invention. Also, arbitrary combinations of the components disclosed in the above-described embodiments can form various inventions. For example, some of the all components shown in the embodiments may be omitted. Furthermore, components from different embodiments may be combined as appropriate.

The invention claimed is:

1. A wireless power transmitting device comprising:

a loop antenna including:

(A) a pair of first linear elements, (B) a feed point connected with one end of each of the first linear elements, (C) a first variable impedance element, one end of which is connected with the other end of one of the first linear elements, (D) a second variable impedance element, one end of which is electrically connected with the other end of the first variable impedance element and the other end of which is electrically connected with the other end of the other of the first linear elements, (E) a second linear element, one end of which is electrically connected with the other end of the first variable impedance element and the other end of which is electrically connected with the other end of the other of the first linear elements; and a self-resonance coil configured to receive, through electromagnetic coupling to the loop antenna, power fed to the feed point of the loop antenna, and to transmit the received power to a receiving self-resonance coil through magnetic resonance; and a controller which sets an initial value of the first variable impedance element to a value different from a maximum value and a minimum value of the first variable impendence element and sets an initial value of the second variable impedance element to a value different from a maximum value and a minimum value of the second variable impedance element.

2. The device according to claim 1, wherein the first variable impedance element is a capacitance value variable capacitor or a capacitance value variable inductor, and the second variable impedance element is a capacitance value variable capacitor or a capacitance value variable inductor.

3. A wireless power receiving device comprising:

a self-resonance coil configured to receive power from a transmitting self-resonance coil through magnetic resonance; and a loop antenna including:

(A) a load, (B) a third variable impedance element, one end of which is connected with one end of the load, (C) a fourth variable impedance element, one end of which is electrically connected with the other end of the third variable impedance element and the other end of which is electrically connected with the other end of the load, and (D) a linear element, one end of which is electrically connected with the other end of the third variable impedance element and the other end of which is electrically connected with the other end of the load; and a controller which sets an initial value of the third variable impedance element to a value different from a maximum value and a minimum value of the third variable impendence element, and sets an initial value of the fourth variable impedance element to a value different from a maximum value and a minimum value of the fourth variable impedance element, wherein the loop antenna is electromagnetically coupled to the self-resonance coil to receive the power and outputs the power through the load.

4. The device according to claim 3, wherein the third variable impedance element is a capacitance value variable capacitor or a capacitance value variable inductor, and the fourth variable impedance element is a capacitance value variable capacitor or a capacitance value variable inductor.

5. The device according to claim 1, wherein the controller sets the initial values of the first variable impedance element and the second variable impedance element to midpoints of variable ranges of the first variable impedance element and the second variable impedance element, respectively.

6. The device according to claim 3, wherein the controller sets the initial values of the third variable impedance element and the fourth variable impedance element to midpoints of variable ranges of the third variable impedance element and the fourth variable impedance element, respectively.

* * * * *